United States Patent [19]

Holzberger et al.

[11] Patent Number: 4,798,518

[45] Date of Patent: Jan. 17, 1989

[54] FAN UNIT FOR USE WITH DUCT SYSTEMS

[75] Inventors: Vinzenz Holzberger, Gaildorf; Friedrich Koger, Neuenstein, both of Fed. Rep. of Germany

[73] Assignee: Wilhelm Gebhardt GmbH, Waldenburg, Fed. Rep. of Germany

[21] Appl. No.: 356,492

[22] Filed: Mar. 9, 1982

[51] Int. Cl.[4] ..... F04D 29/44

[52] U.S. Cl. ..... 415/211; 98/42.02

[58] Field of Search ..... 415/210, 211, 219 C; 98/42.02

[56] References Cited

U.S. PATENT DOCUMENTS

| | | | |
|---|---|---|---|
| 2,268,454 | 12/1941 | Kucher | 415/211 X |
| 2,362,514 | 11/1944 | Warner | 415/211 |
| 3,010,402 | 11/1961 | King | 415/211 X |
| 3,515,498 | 6/1970 | Tomita | 415/208 |
| 3,584,968 | 6/1971 | Keith | 415/210 |
| 3,650,633 | 3/1972 | Benoit | 415/143 |
| 3,946,648 | 3/1976 | Schneider | 98/42.02 |
| 4,245,965 | 1/1981 | Brown | 98/42.02 |

FOREIGN PATENT DOCUMENTS

| | | | |
|---|---|---|---|
| 1628335 | 5/1970 | Fed. Rep. of Germany . | |
| 475781 | 6/1915 | France | 415/211 |
| 404730 | 1/1934 | United Kingdom . | |
| 695948 | 8/1953 | United Kingdom . | |
| 810834 | 3/1959 | United Kingdom . | |
| 1067004 | 4/1967 | United Kingdom . | |
| 1160136 | 7/1969 | United Kingdom . | |
| 1271808 | 4/1972 | United Kingdom . | |
| 1471686 | 4/1977 | United Kingdom . | |
| 2048382 | 12/1980 | United Kingdom | 415/210 |

*Primary Examiner*—Robert E. Garrett
*Assistant Examiner*—Joseph M. Pitko
*Attorney, Agent, or Firm*—Steven L. Permut; Malcolm L. Sutherland

[57] ABSTRACT

A fan unit is designed for installation in ducting systems or in similar casings in air conditioning and ventilation systems. The fan unit has a freely turning radial impeller without any spiral housing and has a driving motor for the impeller. Downstream from the outlet of the impeller, there is a guiding structure for redirecting the flow coming radially out of the impeller to an axial direction.

15 Claims, 3 Drawing Sheets

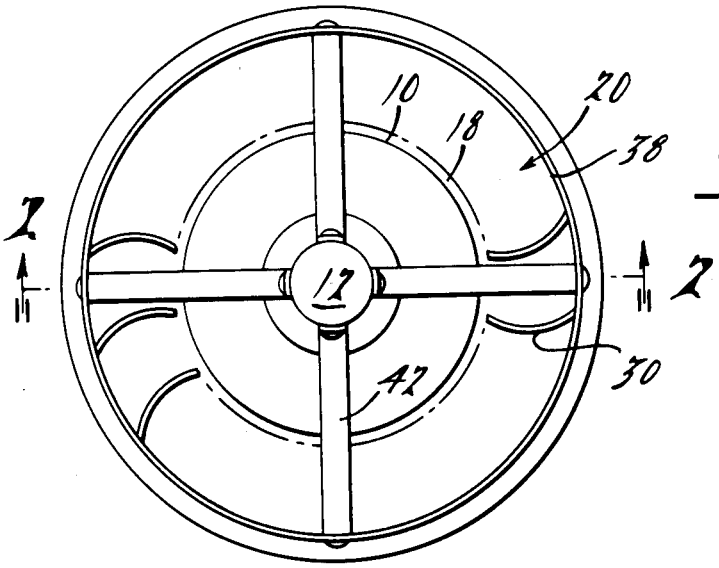
FIG. 1.
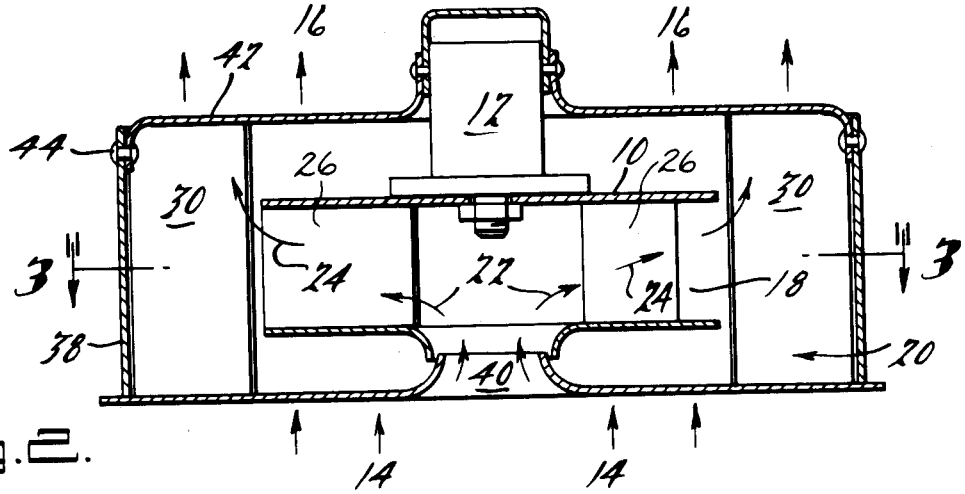
FIG. 2.
FIG. 3.
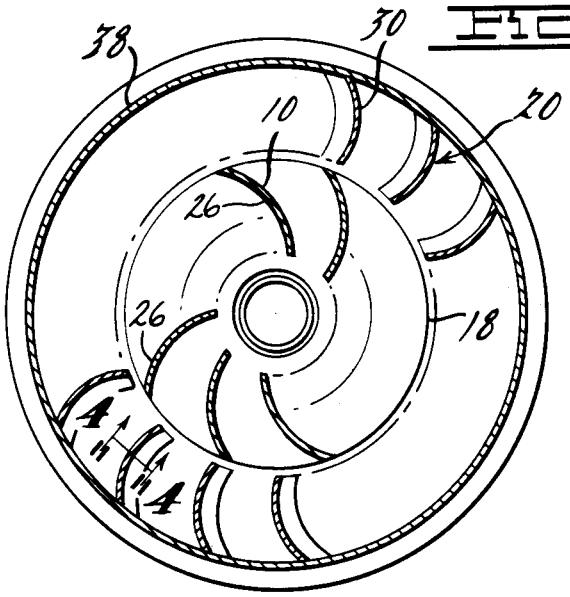
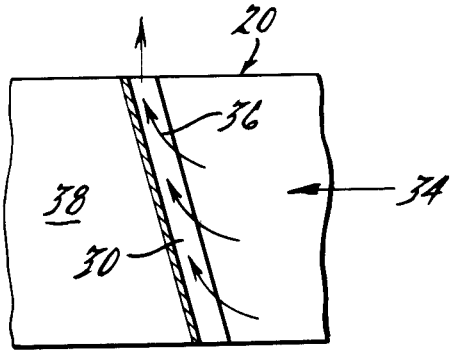
FIG. 4.

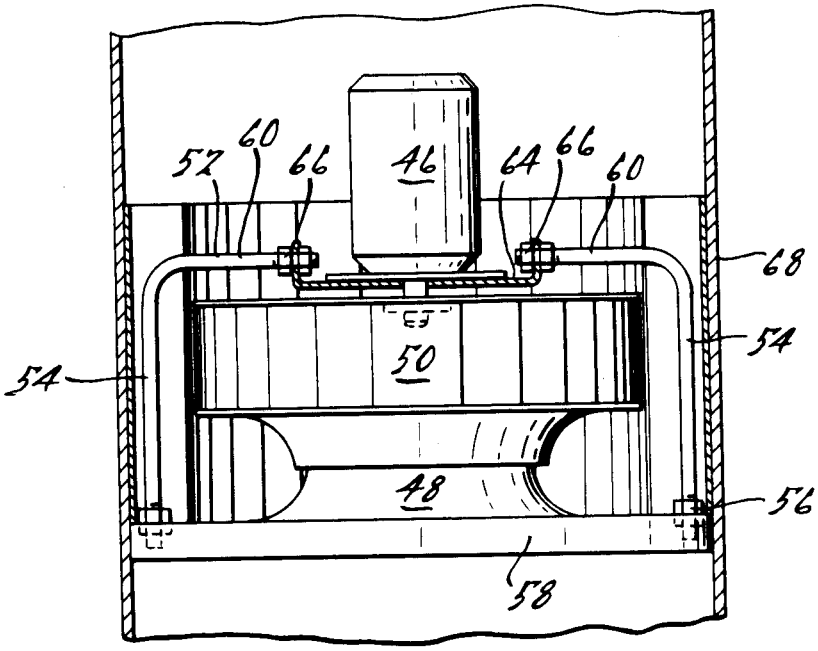
FIG. 5.
FIG. 6.
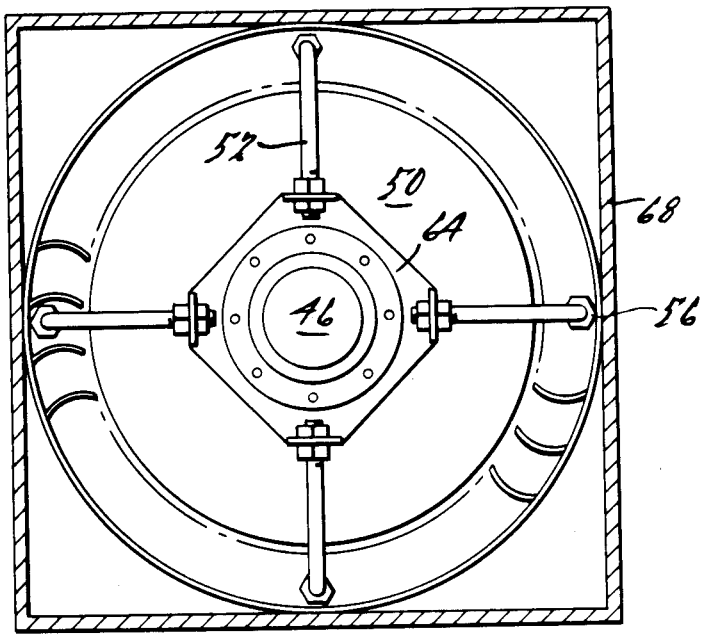

FAN UNIT FOR USE WITH DUCT SYSTEMS

BACKGROUND

The present invention relates to a fan unit designed for use in duct systems, as for example in ventilation and air conditioning systems, and has a freely running radial impeller without a spiral casing and has a driving motor for the impeller. Such fans may be installed in ducting or the like of round or rectangular cross-section and have the advantages and useful effects of an axial fan—the motion of the air or other gas is straight through the fan and there is a simple system for installing the fan in position. In addition, such fans provide the useful effects of a radial fan by providing a high pressure and generally quiet operation. For these reasons, they are used frequently and for a great number of different purposes. Installing this type of fan in position is about as simple as attaching a duct or pipe in position. In this type of fan, the inlet air flows in the same direction as the outlet air, that is, they both flow generally axially.

However, known designs of fans of this type have the shortcoming that the air comes out of the impeller with a high degree of spin and, thus, the path of the volumetric flow of air in the duct downstream from the fan is helical. This spin is responsible for substantial energy losses. A substantial part of the kinetic energy supplied by the impeller to the flow is not usable so that such fans have a comparatively low efficiency. One of the purposes of the present invention is to overcome this shortcoming.

Stated somewhat differently, a purpose of the invention provide a fan unit of the type referred to above and having the advantages of the previous designs but not having the disadvantages of the previous designs. This purpose is accomplished by designing the fan to provide at its outlet side a generally parallel flow. The flow of air in the duct downstream from the fan impeller does not have any spin and, therefor, the energy losses referred to earlier are avoided.

SUMMARY

The present invention provides a fan unit designed for use in a duct system, the fan unit having a freely turning radial impeller without a spiral casing and having a driving motor for the impeller. The fan unit is characterized by a guiding structure placed downstream from an outlet side of the impeller, said guiding structure being designed for redirecting the flow coming from the impeller to an axial direction. Preferably, the guiding structure is placed around the outside of the radial impeller and, if desired, it may be spaced from the outer edge thereof. More particularly, the guiding structure may consist of a wheel, fixed in position, with a number of guide blades which are curved at such an angle that the inlet angle is the same as the outlet direction of the flow coming from the impeller so that the flow may make its way into the guiding structure generally smoothly. A useful effect produced if the guide blades of the guiding structure are placed at such an angle and have such a curved form, is that the flow is changed in direction from the radial direction to the axial direction. The result is a fan unit which not only has the useful properties of previous fans but also is free of the kinetic energy loss of previous fans (which are otherwise generally like the invention) because the flow, after coming out of the impeller, is so changed in direction by the guiding structure that it moves axially without any spin and thus the previously described kinetic energy loss caused by such spin does not longer occur. By designing and locating the blade in the manner claimed in the dependent claims, the properties of the fan are improved in connection with reducing the amount of energy loss. With the further improvement, as claimed in one dependent claim, of providing that the guiding blades are adjustable together in angle, it is possible to be assured of the best possible adjustment and control of the volumetric flow, since such adjustment can be made in small steps, easily, and quickly.

Preferably, the radial impeller, the driving motor and the guiding structure are assembled as a single unit which may be installed in a duct or the like. The guide blades are preferably placed within a cylindrical casing, which casing also forms a housing for the fan unit and holds the unit together. In this respect, the driving motor (which may, for example, be located at the side of the impeller opposite the inlet) may be secured in position by means of a number of radial support rods fixed at their outer ends to the cylindrical casing. Alternatively, it may be located and secured in position using several angled support rods, where each support rod has two legs. One of the legs of each support rod is axially oriented and is fixed at its free end to a support ring (on the inlet side of the fan unit) used for supporting the impeller. The other of the legs of each support rod is radially oriented and is used for supporting the driving motor. By using the above-described preferred design details the structure is made as simple as possible while at the same time it is made inexpensive and easy to install.

The preferred embodiment of the invention is shown in the accompanying figures and is described in detail below.

BRIEF DESCRIPTION OF THE DRAWING

FIG. 1 is a top view of an example of a fan unit and guiding structure according to the present invention;

FIG. 2 is a sectional view thereof taken along line 2—2 of FIG. 1;

FIG. 3 is a sectional view taken along line 3—3 of FIG. 2;

FIG. 4 is a partial sectional view taken along line 4—4 of FIG. 3 and illustrates one portion of the guiding structure at an enlarged scale;

FIG. 5 is a side elevational view of a modified fan unit according to the present invention;

FIG. 6 is a plan view of the fan unit of FIG. 5;

DETAILED DESCRIPTION OF THE PREFERRED EMBODIMENT

Figure 7:
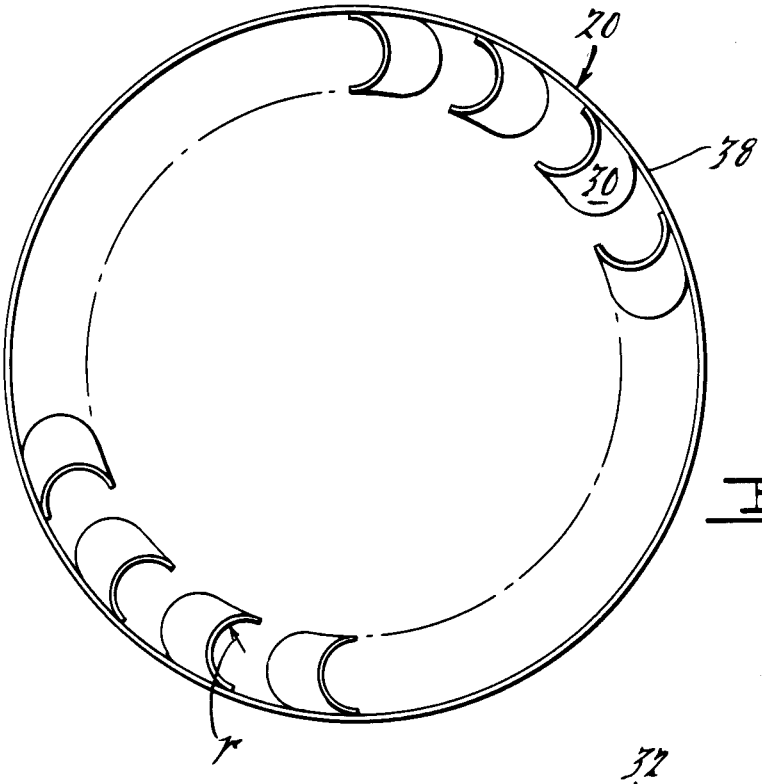
FIG. 7 is a schematic top view of the guiding structure of a further modified fan unit according to the present invention.

The fan unit of the invention may be seen from the drawing and in particular in FIGS. 1, 2 and 3 to be comprised of freely running radial impeller 10 (without a spiral housing) and a driving motor 12 for the impeller 10. The impeller 10 is well known and may be selected from impellers of the prior art that draw air axially and distribute air radially. The driving motor 12 preferably is an external rotor motor with a speed controller, not shown, so that the speed may be changed if, for example, the air flow rate is to be changed in response to changing needs, for example, for reducing the power consumption. In the invention the air flow direction is marked by arrows 14 for incoming air and 16 for outgoing air (FIG. 2). Downstream from an impeller outlet 18 there is a guiding structure 20 receiving the flow coming from the impeller 10 as marked by arrows 22, and redirecting it in the axial direction as marked by arrows 24 until the flow leaves the fan axially as marked by arrows 16. The reader will see that in the working example of FIGS. 1, 2 and 3 the guiding structure 20 (best shown in FIG. 3) is in the form of a fixed wheel with a number of blades 30 and is placed around the perimeter of the radial impeller 10 with a space being provided between the outer edge of the radial impeller 10 and the guiding structure 20. The blades 30 extend axially beyond both axial ends of the impeler blades 26.

As noted above, the guiding structure 20 is made up of a number of guide blades 30, for example 15 to 18 guide blades (and more preferably 17 guide blades). These blades are so positioned that the inlet angle of the blades 30 is equal to the outlet angle or direction of the flow from the blades 26 of the impeller 10 so that the air generally flows smoothly into the guiding structure 20.

Figure 8:
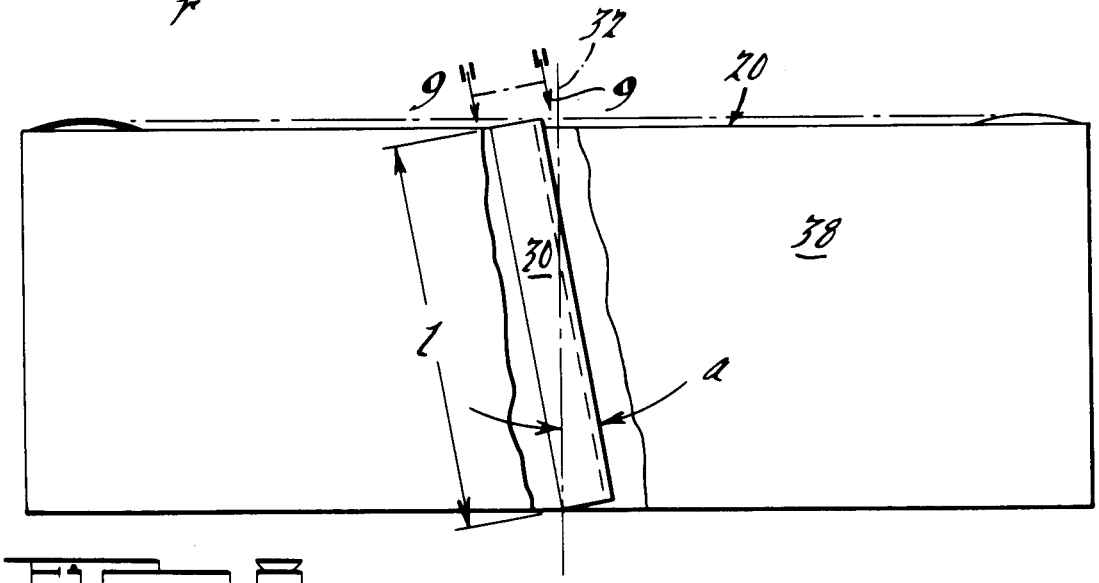
FIG. 8 is a partly schematic elevational view of the guiding structure of FIG. 7 with a portion cut away.

The guide blades 30 of the guiding structure 20 may be designed and placed in a number of different ways. For example the guide blades 30 of the guiding structure 20 of the system of FIG. 7 may be placed (as shown in FIG. 8) at such an angle (a) to the lengthways axis 32 and undergo such adjustment that the flow is guided away from the radial direction to the axial direction. In this respect, for example, the guide blades 30 of the guiding structure 20 may be placed at an angle of seven to fifteen degrees (and preferably 10°) to the impeller axis 32. This may be seen also from FIG. 4 in which the direction of rotation of the impeller is marked by the arrow 34 and the change in direction of the air flow into the axial direction is as marked by the arrow 36. As also shown FIG. 4, the inner edge of the stator blade 30 extends in a substantially rectilinear direction.

It is also possible for the guide blades 30 of the guiding structure 20 to have such a curved form that the flow is changed from the radial direction into the axial direction. Furthermore the guide blades may have a circular or other curved form, the different possible forms of blades helping on the one hand to reduce kinetic energy losses caused by turbulence or changes in direction, and on the other hand to make certain of the best possible and most efficient change in direction of the air flow after coming from the impeller and before it continues into the part of the duct downstream from the fan unit.

Figure 9:
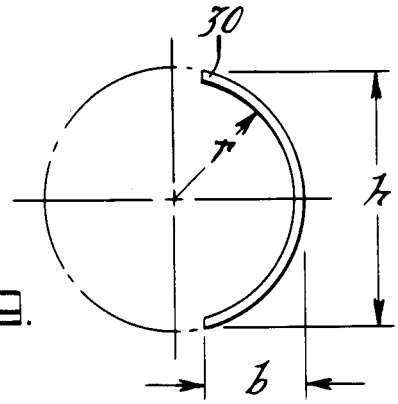
FIG. 9 is a schematic view of a blade of the guiding structure of FIG. 7 as seen from the front.

It will be seen from FIG. 9 that it is possible, again with the purpose of getting the evenest and smoothest flow, to make the length of the blades 30 about five times greater than the radius of curvature r, while the blade height h is about two to three times greater than the blade breadth b.

For ease of adjustment, the guide blades may be so supported that they may be changed in angle and undergo adjustment all together or in common so that the resulting adjustment is optimum and adjustment of the volumetric flow is possible in small steps, the system for doing this being simple and inexpensive.

To provide ease of assembly and a simple design, it is furthermore possible as part of the invention for the radial impeller, its driving motor and the guiding structure 20 to be preassembled into a unit that may be installed in a duct or the like. For this purpose known flanges or reduction pieces or bridge pieces, plug-in connections or the like may be used.

In the working example of FIGS. 1, 2 and 3 the blades are placed within an outer cylindrical casing 38 which functions as the housing of the fan unit and secures all the parts of the fan unit together. In this case the driving motor 12 is placed on the side of the impeller opposite to the air inlet 40 (FIG. 2) into the impeller 10 and is supported in this position by radial support rods 42, whose outer ends are fixed to the cylindrical housing at 44. It may be seen that the guiding structure 20 and the impeller 10 are placed within the casing 38, on which the motor is indirectly supported. Using parts apparent to those skilled in the art, of which no details are given here, the housing may be installed in ducting system.

In the design of FIGS. 5 and 6 the driving motor 46 is again placed on the side of the impeller 50, opposite to the air inlet 48 into the impeller. The motor 46 is kept in position by angled support rods 52. Each rod 52 has a portion 54 running axially and a portion 60 running radially. One end of the radial portion 54 of each rod 52 is fixed by nut 56 to a support ring 58, which is preferably designed for supporting the impeller 50 as well. The other part 60 of the rod 52 is fastened by nut 66 to a support plate 64 for the driving motor 46. In this case as well, in which the fan unit 50 has backwardly curved blades, there is a housing 68, which is placed round the unit and may at the same time be used for handling, locating and attaching the unit to a duct or the like.

The above description is by means of example and includes the preferred embodiment of the present invention. Apparent variations and modifications from the examples disclosed are within the intended scope of the claims appended hereto.

What is claimed as novel is as follows:

1. A fan unit comprising a housing, a radial flow impeller arranged within said housing to be driven by a motor, so as to draw in a gaseous medium which is expelled from the impeller in a radial indirection, and a guide radially enclosing and adjacent to the impeller, the guide being mounted inside the housing which is of substantially uniform cross-section, and having a plurality of axially extending blades arranged to direct the medium flow emerging from the impeller into an axial direction, the guide blades being inclined in a circumferential direction in relation to the axis of rotation of the impeller, and each guide blade having an arcuate profile, in radial section, extending axially beyond blades of the impeller at both ends thereof and having its radially outer edge in proximity or adjacent to said housing.

2. A fan unit in accordance to claim 1, wherein the length of the guide blades is about 5 to 6 times the size of the radius of curvature.

3. A fan unit in accordance to claim 1, wherein the guide blade width is about 2 or 3 times the blade depth.

4. A fan unit in accordance to claim 1, wherein the inlet edge of the guide blade extends substantially in a rectilinear direction.

5. A fan unit in accordance to claim 1, wherein the guide has between 15 and 18 blades.

6. A fan unit in accordance to claim 5, wherein the guide has 17 blades.

7. A fan unit in accordance to claim 1, wherein the guide blades are inclined at an angle of between 7° and 15° to the impeller axis.

8. A fan unit in accordance to claim 7, wherein the guide blades are at an angle of 10° to the impeller axis.

9. A fan unit in accordance to claim 1, wherein the guide blades have such a curvature as to be concave in the direction of rotation of the impeller.

10. A fan unit in accordance to claim 1, wherein the blades of the guide have a circularly curved outline.

11. A fan unit in accordance to claim 1, wherein the housing is cylindrical, and the drive motor is located on the side of the impeller which is opposite to the inlet thereto.

12. A fan unit in accordance to claim 11, wherein support rods support the drive motor, outer ends of the support rods being fixed to the cylindrical housing.

13. A fan unit in accordance to claim 11, wherein angled support rods support the drive motor, each support rod having an axially extending part, and the rods at their free ends mounting a support ring on the inlet side of the impeller, other parts of the angled support rods extending radially and being used for supporting the drive motor.

14. A fan unit in accordance to claim 13, wherein the drive motor is supported by the support ring.

15. A fan unit in accordance to claim claim 11, wherein the radial impeller, the drive motor and the guide are arranged together as a single unit which can be installed in a duct.

* * * * *